US010539045B2

(12) United States Patent
Hernandez Abarca

(10) Patent No.: US 10,539,045 B2
(45) Date of Patent: Jan. 21, 2020

(54) SYSTEM FOR RECOVERING THERMAL ENERGY PRODUCED IN PYROMETALLURGICAL PROCESS PLANTS OR SIMILAR, TO CONVERT SAME INTO, OR GENERATE, ELECTRICAL ENERGY

(71) Applicants: Carlos Alberto Hernandez Abarca, Santiago, C.P. (CL); AMBAR S.A., Santiago, C.P. (CL)

(72) Inventor: Carlos Alberto Hernandez Abarca, Santiago (CL)

(73) Assignees: Carlos Alberto Hernandez Abarca, Santiago (CL); AMBAR S.A., Santiago (CL)

( * ) Notice: Subject to any disclaimer, the term of this patent is extended or adjusted under 35 U.S.C. 154(b) by 0 days.

(21) Appl. No.: 15/771,749

(22) PCT Filed: Nov. 3, 2015

(86) PCT No.: PCT/CL2015/000059
§ 371 (c)(1),
(2) Date: Apr. 27, 2018

(87) PCT Pub. No.: WO2017/075724
PCT Pub. Date: May 11, 2017

(65) Prior Publication Data

US 2018/0347410 A1 Dec. 6, 2018

(51) Int. Cl.
*F01K 27/02* (2006.01)
*F02G 1/053* (2006.01)
*F02G 1/043* (2006.01)

(52) U.S. Cl.
CPC ..... *F01K 27/02* (2013.01); *F02G 1/053* (2013.01); *F02G 1/043* (2013.01); *F02G 2243/00* (2013.01)

(58) Field of Classification Search
CPC ..... F01K 27/02; F02G 1/053; F02G 2243/00; F02G 1/043
(Continued)

(56) References Cited

U.S. PATENT DOCUMENTS 8,432,047 B2 * 4/2013 Schilling ..... F01B 23/10 123/46 E
8,726,661 B2 * 5/2014 Spicer ..... F02G 1/043 60/299
(Continued)

FOREIGN PATENT DOCUMENTS

JP 2006283620 A 10/2006

OTHER PUBLICATIONS

International Search Report, dated Feb. 19, 2016.
Written Opinion, International Searching Authority, dated Feb. 19, 2016.

*Primary Examiner* — Hoang M Nguyen
(74) *Attorney, Agent, or Firm* — Bay State IP, LLC

(57) ABSTRACT

The invention relates to a system for recovering thermal energy produced in pyrometallurgical process plants and converting said thermal energy into electrical energy. The system is characterised in that it comprises at least one heat transfer chamber (1) comprising a gas interface section (1A), for separating the subsystem from the corrosive power of, and incrustation generated by, the gases from the heat source or duct (5). The system also comprises a section (1B) for connecting to a Stirling engine (2), which is a thermal engine and which, by means of the cyclical compression and expansion of a gaseous working fluid, at different temperature levels, produces a net conversion of thermal energy into mechanical energy.

5 Claims, 1 Drawing Sheet

(58) Field of Classification Search
USPC ..... 60/517–526
See application file for complete search history.

(56) References Cited

U.S. PATENT DOCUMENTS

| | | | | |
|---|---|---|---|---|
| 2006/0053785 | A1* | 3/2006 | Mori | B60K 8/00 60/520 |
| 2012/0031079 | A1* | 2/2012 | Spicer | F02G 1/043 60/278 |
| 2014/0174080 | A1* | 6/2014 | Friesth | F01K 3/00 60/641.1 |
| 2015/0275323 | A1* | 10/2015 | Hoffman | C21B 13/0066 75/10.63 |
| 2017/0138302 | A1* | 5/2017 | Leon-Rovira | F02G 5/02 |

* cited by examiner

SYSTEM FOR RECOVERING THERMAL ENERGY PRODUCED IN PYROMETALLURGICAL PROCESS PLANTS OR SIMILAR, TO CONVERT SAME INTO, OR GENERATE, ELECTRICAL ENERGY

CROSS REFERENCE TO RELATED APPLICATION

This application is for entry into the U.S. National Phase under § 371 for International Application No. PCT/CL2015/000059 having an international filing date of Nov. 3, 2015, and from which priority is claimed under all applicable sections of Title 35 of the United States Code including, but not limited to, Sections 120, 363, and 365(c).

Almost all production process has energy losses, which can be classified as Thermal Energy (associated with high and low temperatures), Chemical Energy (associated with municipal or combustible waste) or Mechanical Energy (associated with high pressures and movement).

Although there are many techniques to recover such losses (Waste Energy Recovery), especially for thermal energy losses in furnaces, foundries and smelters, the relevance of this invention is to provide a system for recovery of the heat losses (Heat Recovery) with scalable units recovering the heat (for conversion into electrical energy) which are distributed in selected places of production processes (e.g. metals smelters).

This system is a less intrusive solution in the infrastructure of a production process, if compared with those caused by alternate solutions.

Historically, the traditional alternative solutions consider directing the hot gases to a concentration point, where the heat is converted into electricity using traditional techniques. For example, by transferring the heat to water, obtaining steam from such transfer and using it as the driving force for a turbine. Furthermore the transportation of hot gases increases the complexity in production processes, depending on their composition which is often with high corrosive power. Processes also increase its complexity given the pressure associated to gases.

On the other hand, the inclusion of devices in gas transportation pipelines involve different levels of consequences, depending on the corrosive power of gases and the generation of incrustations in the insertion point, including crystallizations and metal-inlays in some cases.

The invention consists of a system composed of subsystems which generate electricity from the residual heats of a productive process (the pyro-metallurgical process in a foundry for example). The basic elements of each subsystem are the following:

A heat transfer chamber (1) contained in a cylindrical flanged spool (4) for one or more cameras (1) which captures the heat from the source (5) such as chimney/smokestack, vent process or other heat transport device. The heat is transferred to a type Alpha, Beta, Gamma (or derivatives) Stirling engine (2) which is responsible for generating the mechanical movement of an axle. A mechanical-electrical converter (3) converts the mechanical energy into electrical energy that is transported into a concentrator hub (6) through protected wires (7) for distribution to the loads and/or for connection to the electrical network.

By mean of this, one or more subsystems of generation that are installed on a flanged spool, generate electricity in different parts of the production process—or in a distributed mode-, transporting electricity through wires to a centralized unit that concentrates the power of each subsystem, conditioning it to appropriate levels and leaving it available for distribution to different processes, plants, or definitively to the main power or electrical grid.

Particularly and in order to take advantage of the unused thermal energy, in the plants of pyro-metallurgical processes it is a technique and economic problem to move the hot gases—or the energy in the form of heat—toward a unique place to then convert it into electricity. In addition, it is highlighted the problem of having devices that are in contact with the gas, given the high corrosive power of these and the generation of metal-inlay in these areas, making the heat transference more difficult.

This invention solves these technique problems by using a "System for Recovery of Thermal Energy and Distributed Generation of Electricity in Pyro-metallurgical Processes".

The system turns on electricity the heat associated with gases produced in an industrial process. Each subsystem that comprises the system, generates more than 2 KW using a camera to capture the heat from the gases, a Stirling engine, a converter of movement into electricity, as well as the adjustments of voltages and currents.

Regarding the use of thermal or geothermal energy or similar power, to convert it into electric energy, we can mention the patent CN201819575, which refers to a utility model that describes a system of use of residual heat of a metallurgical furnace steam to generate electricity. The system comprises several joint gas saturation and heat waste incineration furnaces turbo-generator, and also a steam accumulator, a distribution of high pressure gas cylinder and a lower gas pressure distribution of cylinder to supply heat to the users. Residual heat of flue gas furnaces are communicating with cylinder gas distribution of high pressure, which is in part connected with the distribution of gas at low pressure of the cylinder through a pressure adjustment valve and a valve d e adjust flow and on the other hand with the turbo generators. Battery of steam which is connected between the valve's pressure setting and flow adjustment valve is used to store heat during high peak of steam generation and supply heat to the distribution of low pressure gas cylinder during the low peak of steam generation. Turbo-generators sets are connected with distribution of low pressure gas cylinder and are used for, during the peak of the generation of steam, transmitting part of the steam cylinder work being done in low pressure gas distribution. System that not only improves the quality of steam allows assemblies to operate stably and prolongs the life of the sets, but they also provided steam heat sources for users, which allows the use cascade of steam power and the improvement of waste heat recovery efficiency.

Another patent for geothermal heat recovery is the U.S. Pat. No. 4,047,093, which refers to a system in situ for the conversion of geothermal energy in energy power, which includes the drilling of a well from the surface of the ground in an underground geological stratum under high temperature, comprising in combination:

a) A first tubular structure to route the high temperature heat, laid out in formal longitudinal aligned parallel to the axis of a well having a bottom section thermally coupled to these geological layers of high temperature and a section of upper end that extends towards the surface of the soil, (b) a second tubular structure for low temperatures, which is arranged longitudinally aligned parallel to the axis of this well, which has a lower end section to coaxially receive the upper end section of this tubular structure for heat, which defines an annular volume between the section of the upper end of the tube (in tubular high-temperature structure) and the end section that surrounds the bottom of the structure of low temperature, (c) Means to cool the said second tubular structure of high temperature.

(d) Means of conversion positioned within this defined annular gap between the upper section of this high-temperature structure and the final section heat tube surrounding the bottom of this structure for heat pipe low-temperature coupling heat the first structure's second such high-temperature heat-pipe low temperature heat pipes and to generate an electric current in response to a temperature difference between these first and second heat pipes, structures and (e) Means connected to such media conversion to carry out this existing electrical generation to the surface of the soil.

Another patent from thermal to electrical energy conversion, is the patent is U.S. Pat. No. 267,842, which refers to a procedure characterized as, on one hand, a quick steam jet of fluid (supersonic preferred) is obtained between a first zone heated in which this gathered a mass of the fluid in a condensed state, and a second zone cooled using a turbinate which separates both areas and the maintenance of a suitable temperature difference of the walls of these two areas, and on the other hand, that ionized Jet through a plurality of electrodes electrically linked to use of electric power apparatus.

BRIEF DESCRIPTION OF THE FIGURES

The following is a brief figure's description for better understanding of the invention "System for Recovery of Thermal Energy produced in pyro-metallurgical processes plants" or similar to convert it into electrical energy. The description is based on the figures that are an integral part of this invention, without restriction or limitations to the obvious changes that could emerge, where.

DESCRIPTION OF THE INVENTION

Figure 1:
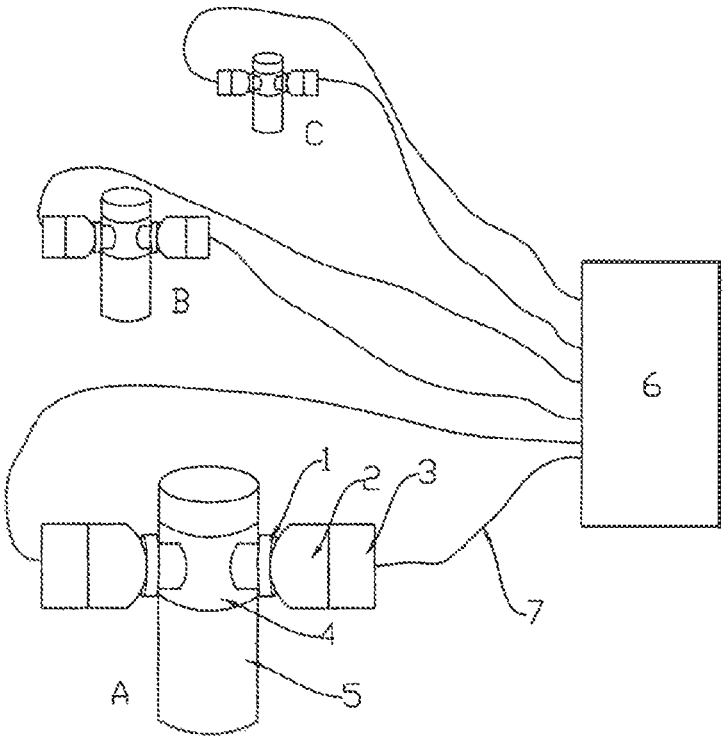
FIG. 1, shows a general representative overview of the converter system form thermal energy into electrical energy.
Figure 2:
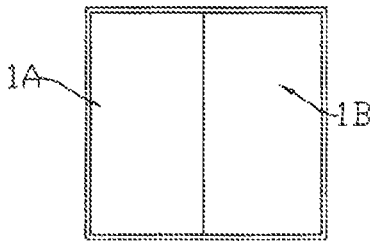
FIG. 2 shows a view with a heat transfer camera from the invention.
Figure 3:
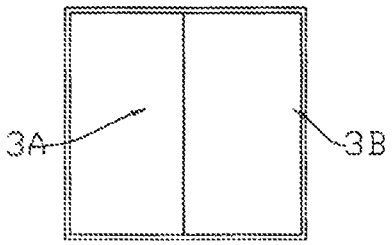
FIG. 3, shows a view with the mechanical-electrical converter of the invention.

According to FIGS. 1 to 3, the system for recovery and conversion of thermal energy, produced in the plants of pyro-metallurgical processes or similar, to generate or convert it into electric energy, is comprised of at least one Chamber of (1) heat transfer, which is composed of a section of interface to gases (1A), with appropriate materials and physical design features, to make the subsystem independent of the corrosive power and accretions of the gases from the heat source (5). In addition, it is composed for a section linking (1B) with a type of Stirling engine (2) (Type alpha, beta, gamma or derivatives), which is an internal combustion engine that produces a net conversion of heat energy into mechanical energy by cyclic compression and expansion of a gaseous working fluid at different levels of temperature. The mechanical energy obtained by the Stirling engine, is converted into electrical energy through the use of a mechanical-electrical converter (3), which is composed of two sections: The first section performs the conversion of mechanical energy to electrical energy with different variabilities characteristics (3A) and a section of stabilization of electric power (3B) whose function is to provide electricity with the condition to be transported via standard cables and for commercial use.

There is in addition a cylindrical flanged spool that works as a support ring (4) allowing the subsystem to stay mechanically connected with piping thermal energy source and absorbing part of the vibrations inherent to the existing pipelines in the pyro-metallurgical processing plants.

Each subsystem that comprises the system generates more than 2000 Watts, using a heat transfer camera to capture the heat from the gases, a Stirling engine, a converter of movement into electricity and the adjustments of voltages and currents.

The system is composed of subsystems SHR-Stirling (Smelter Heat Recovery with Stirling Engine) characterized to be installed in contact with the source of thermal energy to generate over 2 Kw of power electricity, so that to have it transported via cables to the places where is distributed to loads or connected to the main network.

Each subsystem SHR-Stirling is installed in contact with the hot gases of a pyro-metallurgical processing plant, although the contact interface insulates the rest of the subsystem from both, the corrosion of the gases and the metal accretion or pollution caused for these gases.

The SHR-Stirling subsystems allow the conversion of thermal energy into electrical energy with devices distributed in the metallurgical process and thus, being able to concentrate energy for use by loads or connecting to the power network in the form of electrical energy, which is more efficient and economical than the alternate of concentrate the thermal energy in a sole place. To do it so, the hot gases should be transported through appropriate infrastructure pipelines suited for such purpose.

Each subsystem is composed of four key sections to perform the conversion distributed thermal energy to electrical energy (see FIG. 1)

1. (1) Heat Transfer Chamber consisting of 2 sections;
   (a) Gas Interface (1A), with characteristics, materials and physical design appropriated for isolating the subsystem form the corrosive power and generation of accretions of gases from the source of heat (5).
   b) Link (1B) section with the Stirling engine (2)
2. Engine Stirling (2):
   Thermal heat engine which uses a cyclic compression and expansion of a gaseous working fluid—at different levels of temperature-, to produce a net conversion of heat energy to mechanical energy.
3. Mechanical-electrical converter (3) that transforms mechanical energy into electrical energy, which—through a duly insulated and canalized cable (7)—, carries the power to a hub for distribution to the loads or connection to the mains (6). The converter is at the time composed of following two sections:
   (a) Section for Conversion from mechanical to electrical energy (3A) energy, with variable voltage and current levels and
   b) Section of stabilization of electric power (3B) whose function is to provide electricity with conditions to be transported via standard cables and for commercial use.
4. Ring or Cylindrical Flanged Spool (4) of one or more cameras (1), which captures the heat from the source (5) such as chimney/smokestack, vent process or other heat transport device. The heat is transferred to a Stirling engine (2), Alpha, Beta, Gamma or derivatives), which is responsible for generating the mechanical movement of the axle.

The invention claimed is:

1. A system configured for the recovery and conversion of heat energy produced in puro-metallurgical processing plants into electric energy, the system comprising:

a plurality of subsystems, wherein each subsystem comprises:

a set of heat transfer chambers;

a cylindrical flanged spool, wherein the cylindrical flanged spool contains the set of heat transfer chambers to capture a quantity of heat from a heat source;

a set of stirling engines, wherein each stirling engine is connected to a corresponding heat transfer chamber to generate a net conversion of heat energy to mechanical energy;

a set of mechanical-electrical converters, wherein each converter is connected to a corresponding stirling engine to transform mechanical energy to electrical energy and further comprises:

a section for conversion from mechanical to electrical energy with variable voltage and current levels; and a section of stabilization of electric power configured to provide electricity for commercial use;

a concentrator hub; and a set of protected wires, wherein each protected wire connects a corresponding converter to the concentrator hub for distribution of the electric power to an electrical network;

wherein each heat transfer chamber comprises a gas interface and a link section with a corresponding stirling engine.

2. The system configured for the recovery and conversion of heat energy produced in puro-metallurgical processing plants into electric energy of claim 1, wherein each subsystem generates more than two kilo watts of electrical power.

3. The system configured for the recovery and conversion of heat energy produced in puro-metallurgical processing plants into electric energy of claim 1, wherein the stirling engine is selected from the group consisting of: alpha, beta and gamma.

4. The system configured for the recovery and conversion of heat energy produced in puro-metallurgical processing plants into electric energy of claim 3, wherein each stirling engine is an internal combustion engine that produces a net conversion of heat energy into mechanical energy by cyclic compression and expansion of a gaseous working fluid at different levels of temperature.

5. The system configured for the recovery and conversion of heat energy produced in puro-metallurgical processing plants into electric energy, of claim 1, wherein the heat source is selected from the group consisting of: a chimney, a smokestack, a vent and any other heat transport device.

* * * * *